United States Patent [19]

Beis

[11] 4,260,961

[45] Apr. 7, 1981

[54] COMPENSATOR FOR TWO ANGULARLY OFFSET JOINED WAVE GUIDES

[75] Inventor: Konstantinos Beis, Backnang, Fed. Rep. of Germany

[73] Assignee: Licentia Patent-Verwaltungs-G.m.b.H., Frankfurt am Main, Fed. Rep. of Germany

[21] Appl. No.: 973,615

[22] Filed: Dec. 27, 1978

[30] Foreign Application Priority Data

Jan. 4, 1978 [DE] Fed. Rep. of Germany ..... 2800266
Jan. 4, 1978 [DE] Fed. Rep. of Germany ... 7800177[U]

[51] Int. Cl.[3] ..... H01P 1/165; H01P 5/00
[52] U.S. Cl. ..... 333/21 A; 333/33; 333/254
[58] Field of Search ..... 333/21 A, 33, 254, 257

[56] References Cited

U.S. PATENT DOCUMENTS 2,975,383 3/1961 Seling ..... 333/21 A

*Primary Examiner*—Paul L. Gensler
*Attorney, Agent, or Firm*—Spencer & Kaye

[57] ABSTRACT

A compensating arrangement for two aligned, angularly relatively offset, end-to-end positioned wave guides of identical cross section. The compensating arrangement has a plate member inserted between face-to-face arranged terminal flanges of the two wave guides. The plate member has an aperture corresponding to the cross-sectional area of the passage defined together by the two wave guides; and two oppositely located capacitive loads extending into the aperture and being symmetrically located with respect to the bisector of the angle defined by the minor transverse axes of the wave guides. The capacitive loads are reactance members for a broad-band compensation for the discontinuity between the angularly offset wave guides.

8 Claims, 6 Drawing Figures

COMPENSATOR FOR TWO ANGULARLY OFFSET JOINED WAVE GUIDES

BACKGROUND OF THE INVENTION

This invention relates to a compensating arrangement for two aligned, angularly relatively offset, end-to-end positioned wave guides of identical cross section. The compensating arrangement includes a reactance element arranged in the zone of discontinuity between the wave guides for effecting a broad-band compensation for the discontinuity between the offset wave guides.

U.S. patent application Ser. No. 957,005, filed Nov. 2nd, 1978 proposes an arrangement as outlined above for coupling an antenna to a directional transmitting system in order to provide that, if needed, the direction of polarization of a transmitted wave can be adjusted. For example, the wave guides may be twisted with respect to one another in such a manner that the transmitted wave is polarized either horizontally or vertically.

SUMMARY OF THE INVENTION

It is an object of the invention to provide an improved arrangement for effecting in a simple manner a compensation for the discontinuity between the wave guides.

This object and others to become apparent as the specification progresses, are accomplished by the invention, according to which, briefly stated, the compensating arrangement has a plate member inserted between the face-to-face arranged flanges of the two wave guides. The plate member has an aperture corresponding to the cross-sectional area of the passage defined together by the two wave guides; and two oppositely located capacitive loads extending into the aperture and being symmetrically located with respect to the bisector of the smaller angle defined by the minor transverse axes of the wave guides.

DESCRIPTION OF THE PREFERRED EMBODIMENTS

Figure 1:
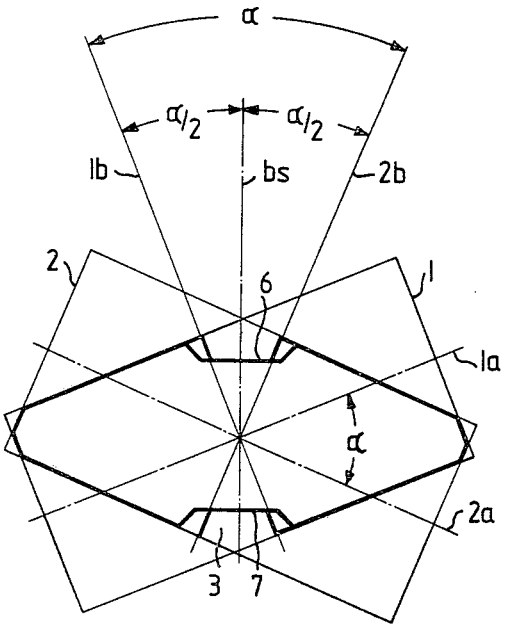
FIG. 1 is a schematic end view of two end to end positioned wave guides incorporating the invention.
Figure 2:
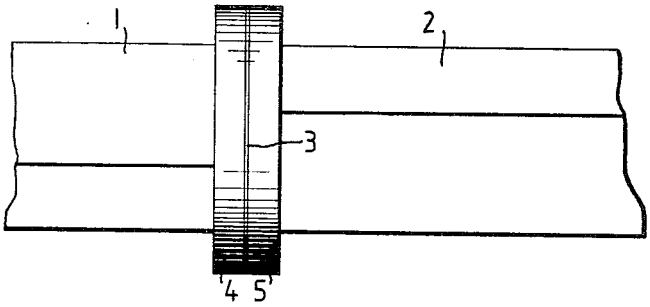
FIG. 2 is a top plan view of the arrangement shown in FIG. 1.

Turning now to FIG. 1, there are shown in schematic end view, the outline of two wave guides 1 and 2, whose major transverse axes 1*a* and 2*a* are offset at an angle $\alpha$ with respect to one another. Between the two wave guides in the zone of their discontinuity there is arranged a compensating plate 3 which has an aperture aligned with the overlapping cross-sectional area of passage of the two wave guides. The compensating plate 3 has oppositely located stubs 6 and 7 which constitute capacitive loads and which project into the plate aperture and thus into the cross-sectional area (passage) of the two wave guides. Each stub 6 and 7 extends symmetrically to the bisector bs of the angle $\alpha$ between the two minor transverse axes 1*b* and 2*b* of the wave guides 1 and 2, respectively. FIG. 2 shows the junction zone (zone of discontinuity) between the two wave guides 1 and 2 in plan view; the compensating plate 3 is arranged between the face-to-face arranged terminal flanges 4 and 5 of the wave guides 1 and 2, respectively.

Figure 3:
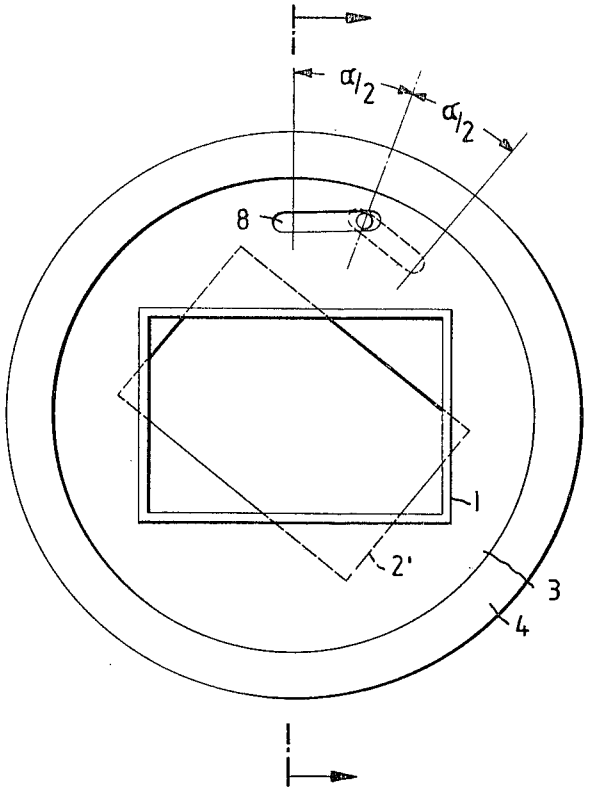
FIg. 3 is an end view of one of the wave guides as seen from the location of junction with the other wave guide.

FIG. 3 is an end view of the wave guide 1 and its associated flange 4 which is of circular configuration. The rectangle 2' shown in phantom lines indicates the position of the wave guide 2 which is to be attached to the wave guide 1 in an angularly offset (twisted) relationship therewith.

Figure 4:
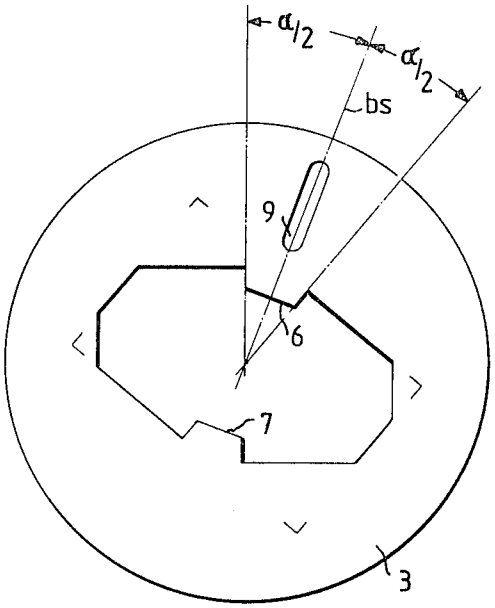
FIG. 4 is a view of a compensating plate according to the invention.

Turning now to FIG. 4, there is illustrated the compensating plate 3 which is of circular disc shape. It has a polygonal aperture, the outline of which corresponds to the configuration of the open cross-sectional area resulting from the overlap of the two relatively angularly offset wave guides 1 and 2.

Figure 5:
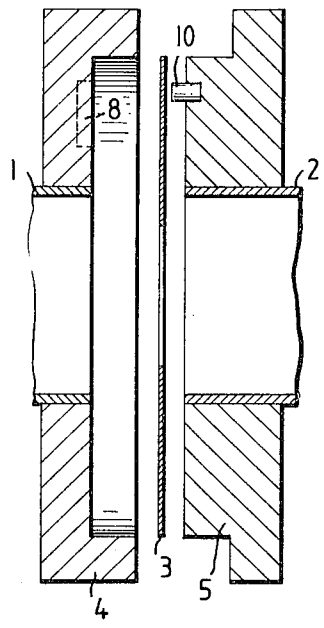
FIG. 5 is an exploded axial sectional view of the junction zone (zone of discontinuity) between the two wave guides, incorporating a preferred embodiment of the invention.

Turning now to FIG. 5, there is shown, in an exploded axial sectional view, the zone of discontinuity between the two wave guides 1 and 2. The compensating plate 3 is arranged between the flanges 4 and 5 of the wave guides 1 and 2, respectively. The flange 4 has in its face a shallow cylindrical depression into which fits a complemental cylindrical projection of the flange 5, so that the flange 5 is rotatably supported within the flange 4.

In modes of application, where a continuous rotation over a large angular range with constant mismatch is required, the arrangement according to the invention is expediently so designed that the compensating plate is, by means of a positive guide, always maintained on the bisector bs. For this purpose, in the flange 4 and in the compensating plate 3 there are provided slots 8 and 9, respectively, while in the flange 5 there is affixed a guide pin 10 which projects into the slots 8 and 9 and thus effects a positive guidance thereof.

The thickness of the compensating plate and the size of the capacitive loads 6 and 7 projecting into the open cross-sectional area of the wave guides are experimentally determined for the given wave guide cross section. For example, in using two standardized rectangular wave guides R/40, the capacitive load was so selected that the portion of the compensating plate which projects into the wave guide passage had a length which was approximately $\frac{1}{8}$ of the length of the small side of the wave guide and was laterally bounded with straight lines corresponding to the twist angle. The thickness of the compensating plate was 0.3 mm.

With the compensating arrangement according to the invention, there is achieved a broad-band compensation, since the discontinuity at the wave guide junction is compensated for at the location of its appearance. The arrangement makes possible a satisfactory compensation for various, even continuously adjustable twist angles. It is further feasible to remove the compensating plate from between the flanges if a twist angle of 0° is required.

In the microwave technology, twisted wave guide portions or flexible wave guides are needed to make possible a continuation of a wave guide line with a predetermined or adjustable twist angle. Known twisted wave guide portions or flexible wave guides require a relatively large structural length for a predetermined twist angle. The compensating arrangement structured according to the invention, by virtue of its very short structural length, may thus find application for such a purpose as well. According to the given requirements in such a case, one may, for example, combine two compensating arrangements according to FIG. 5 into a structural unit with the interposition of a short-length wave guide portion. By means of the common alignment of the two compensating plates with respect to the interposed wave guide portion, coefficients of reflection are obtained which are comparable with the more expensive and very long twisted wave guide portions used heretofore. A structural unit, for example, may have a total length which is smaller than or equal to $\lambda/4$, wherein $\lambda$ is the median operational wave length of the wave guide.

Figure 6:
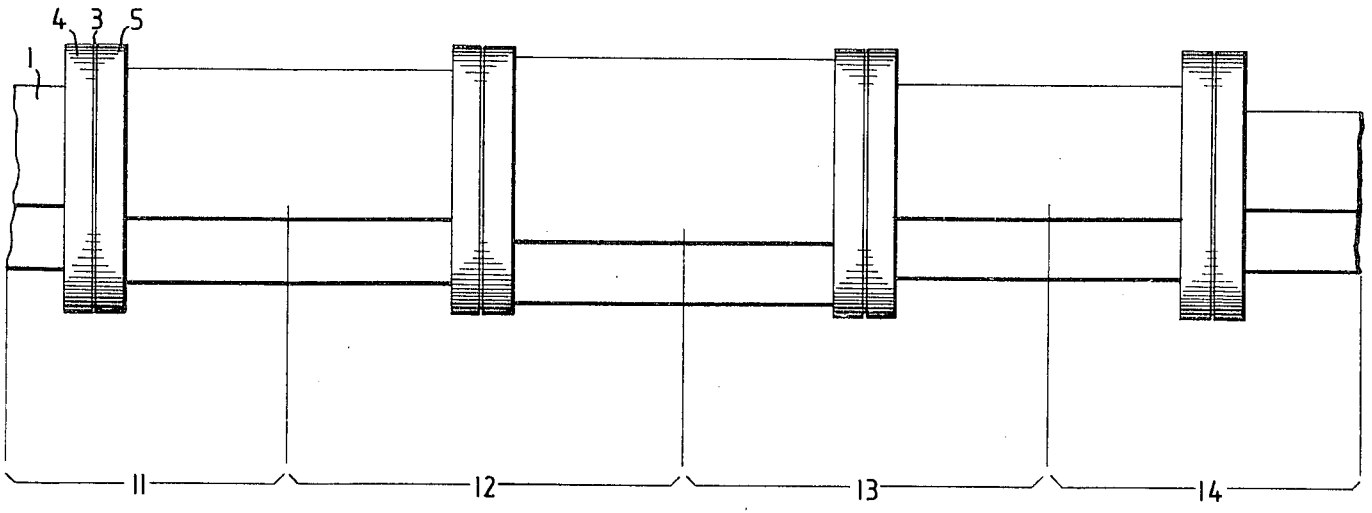
FIG. 6 is a schematic side view of a special embodiment of the invention.

A special embodiment is shown in FIG. 6 with a plurality of parts 11, 12, 13, 14 of foresaid compensating arrangements, which are forming a twisted wave guide portion. The twist angle between the serially connected parts may be equal or different.

It is to be understood that the above description of the present invention is susceptible to various modifications, changes and adaptations and the same are intended to be comprehended within the meaning and range of equivalents of the appended claims.

What is claimed is:

1. In a compensating arrangement for two aligned, angularly relatively offset wave guides positioned end-to-end in a junction zone; said wave guides having identical cross-sectional areas each having a major transverse axis and a minor transverse axis; each wave guide having a terminal flange; said terminal flanges of the respective wave guides being arranged face-to-face in said junction zone; the compensating arrangement including a reactance means situated in said junction zone for a broad-band compensation for the discontinuity between the angularly offset wave guides; the improvement wherein said compensating arrangement comprises a plate member inserted between said flanges; said plate member having (a) an aperture having a shape corresponding to the outline of an overlapping portion of the cross-sectional areas of the two angularly relatively offset wave guides;

(b) two oppositely located capacitive loads extending into said aperture and being symmetrically located with respect to the bisector of the angle defined by the minor transverse axes of said wave guides; said capacitive loads constituting said reactance means; and (c) a positive guiding means for maintaining said capacitive loads on said bisector independently from the twist angle between said wave guides.

2. A compensating arrangement as defined in claim 1, wherein said positive guiding means comprises (a) a first slot provided in one of said flanges;

(b) a second slot provided in said compensating plate; and (c) a pin attached to the other of said flanges; said pin extending through said second slot and projecting into said first slot.

3. In a compensating arrangement for two aligned, angularly relatively offset wave guides positioned end-to-end in a junction zone; said wave guides having identical cross-sectional areas each having a major transverse axis and a minor transverse axis; each wave guide having a terminal flange; said terminal flanges of the respective wave guides being arranged face-to-face in said junction zone; the compensating arrangement including a reactance means situated in said junction zone for a broad-band compensation for the discontinuity between the angularly offset wave guides; the improvement wherein said compensating arrangement comprises a plate member inserted between said flanges; said plate member having (a) an aperture having a shape corresponding to the outline of an overlapping portion of the cross-sectional areas of the two angularly relatively offset wave guides;

(b) two oppositely located capacitive loads extending into said aperture and being symmetrically located with respect to the bisector of the angle defined by the minor transverse axes of said wave guides; said capacitive loads constituting said reactance means; and (c) means providing for a continuous setting of the twist angle between said wave guides.

4. A compensating arrangement as defined in claim 3, wherein one of said flanges has a central cylindrical depression and the other of said flanges has a central cylindrical projection received in said cylindrical depression.

5. A compensating arrangement as defined in claim 3, comprising a plurality of serially-connected compensating arrangements for forming a twisted wave guide portion.

6. A compensating arrangement as defined in claim 1 or 3, wherein said wave guides are in an end-to-end arrangement on either side of a plane where said discontinuity occurs; said plate member being a thin, flat component arranged substantially coplanar with said plane; and further wherein said capacitive loads are substantially coplanar with said plane.

7. A compensating arrangement as defined in claim 6, wherein said flanges are in a direct contact with one another.

8. A compensating arrangement as defined in claim 6, wherein said capacitive loads are stubs forming part of and being coplanar with said plate member; and further wherein said stubs project into the aperture and are coplanar therewith.

* * * * *